United States Patent [19]

Okamoto et al.

[11] Patent Number: 4,486,747

[45] Date of Patent: Dec. 4, 1984

[54] GAS DISCHARGE DISPLAY APPARATUS CAPABLE OF EMPHASIS DISPLAY

[75] Inventors: Yukio Okamoto, Sagamihara; Shinichi Shinada, Kokubunji; Tadao Okabe, Hachioji; Kazuhito Ikarashi, Niigata; Osamu Igarashi, Katsuta, all of Japan

[73] Assignee: Hitachi, Ltd., Tokyo, Japan

[21] Appl. No.: 311,764

[22] Filed: Oct. 15, 1981

[30] Foreign Application Priority Data

Oct. 20, 1980 [JP] Japan ..... 55/148540[U]

[51] Int. Cl.[3] ..... G09G 3/00

[52] U.S. Cl. ..... 340/753; 340/768; 340/771; 340/805; 340/793

[58] Field of Search ..... 340/768, 769, 713, 714, 340/776, 777, 805, 767, 793, 753, 754, 771, 772

[56] References Cited

U.S. PATENT DOCUMENTS

| | | | |
|---|---|---|---|
| 3,334,269 | 8/1967 | L'Heureux | 340/772 |
| 3,876,906 | 4/1975 | Walters | 340/767 |
| 3,953,886 | 4/1976 | Ngo | 340/767 |
| 4,009,414 | 2/1977 | Bockett-Pugh | 340/753 |
| 4,233,544 | 11/1980 | Coleman | 340/805 |
| 4,247,802 | 1/1981 | Kurokawa | 340/769 |
| 4,253,044 | 2/1981 | Smith | 340/714 |

*Primary Examiner*—Marshall M. Curtis

*Attorney, Agent, or Firm*—Antonelli, Terry & Wands

[57] ABSTRACT

A gas discharge display apparatus comprises at least a number of anodes and cathodes each disposed in opposition to each of the anodes so that the anodes and the cathodes are arrayed alternately with each other. The anodes and the cathodes are wired, respectively, in polyphase connections. Discharge stabilizing resistors are connected in series to the polyphase connections leading to either the anodes or cathodes. Pulse voltages are successively applied to the anodes and the cathodes so that the discharge produced between both electrodes is caused to perform self-scanning, while the pulse voltages are applied to the polyphase connections leading to the anodes during a period determined in accordance with an input signal to be displayed, thereby to produce discharge between selected ones of anodes and cathodes determined in accordance with the input signal, said discharge being imparted with a memory effect. By controlling pulse duration of the pulse voltages applied during the period determined by the input signal, brightness of display element(s) selected in accordance with the input signal is controlled in a rather arbitrary manner.

17 Claims, 13 Drawing Figures

GAS DISCHARGE DISPLAY APPARATUS CAPABLE OF EMPHASIS DISPLAY

The present invention relates to a display apparatus for displaying graphic patterns, characters or the like by making use of D.C. discharge. More particularly, the invention concerns a gas discharge display apparatus of an electronic type which can be advantageously employed in place of hitherto known mechanical moving point (cursor) display devices and enjoy wide applications as the display devices for industrial measuring instruments, electric and electronic apparatus for domestic use, audio instruments and the like.

As a typical one of the display devices in which D.C. discharge phenomenon is made use of, there has been widely known a self-scan type display device which includes an array of plural display elements each constituted by at least an anode and a cathode disposed in opposition to each other. The anodes and the cathodes are wired, respectively, in polyphase connection and applied with pulse voltages so that electric discharge occurring between the anode and the cathode is successively shifted or transferred from one to another display element. This shift or transfer of the discharge is referred to as the self-scan or self-scanning. The display device of this type is advantageous in that an increased number of the display elements and hence the number of electrode pairs (i.e. pairs of at least anode and cathode) does not involve a corresponding increase in the number of terminals and driving circuits. However, the device suffers a drawback that display brightness or luminance is at a low level. For example, when the number of the electrode pairs or display elements which are addressed during a period corresponding to a frame is represented by N, the duty ratio of discharge produced by the individual electrode pairs is then 1/N. In other words, the display brightness of the display elements is decreased in inverse proportion to the number of the electrode pairs or display elements.

An object of the present invention is to provide an improved gas discharge display device or apparatus which is immune to the shortcomings of the hitherto known gas discharge display devices while enjoying advantages thereof and in which brightness of a desired display element or elements can be increased to thereby enhance visibility (visual recognizability) of display.

In view of the above and other objects which will become apparent as description proceeds, there is proposed according to an aspect of the invention, a gas discharge display apparatus which comprises a plurality of first electrodes disposed in a row and wired in polyphase connection, a plurality of second electrodes wired in polyphase connection and each disposed in opposition to each of the first electrodes and spaced therefrom, first voltage applying means for applying successively first pulse voltages to the connections leading to the first electrodes, and second voltage applying means for applying successively second pulse voltages to the connections leading to the second electrodes, wherein discharge produced between the first and second electrodes by the first and second pulse voltages is caused to attain self-scanning, and which further includes discharge stabilizing resistors connected to the connections leading to either the first or second electrodes, and third pulse voltage applying means for applying third pulse voltages to each of the connections leading to the second electrodes at a predetermined time instant determined in accordance with an input signal to be displayed, wherein discharge is produced by the third pulse voltage between selected ones of the first and second electrodes determined in accordance with the input signal, the discharge being sustained between the selected ones of the first and second electrodes by applying therebetween a potential produced by the discharge stabilizing resistors and having a level between a breakdown voltage and a minimum discharge maintenance voltage.

The present invention will be apparent from the following detailed description taken in conjunction with the accompanying drawings, in which.

Figure 4A:
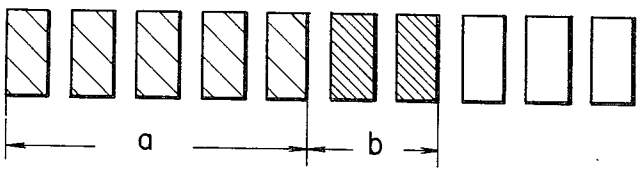
Figure 4B:
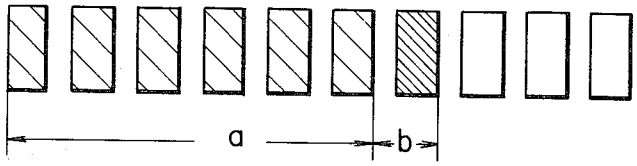
Figure 5:
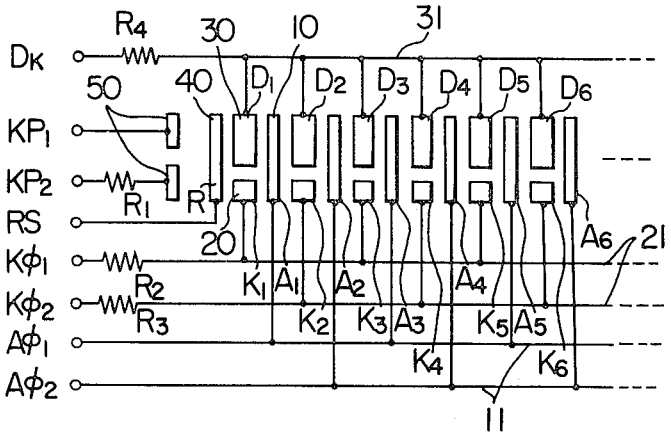
Figure 9:
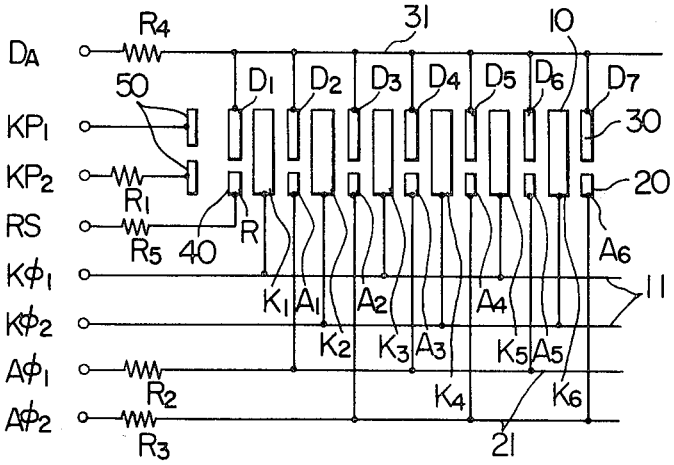
Figure 6:
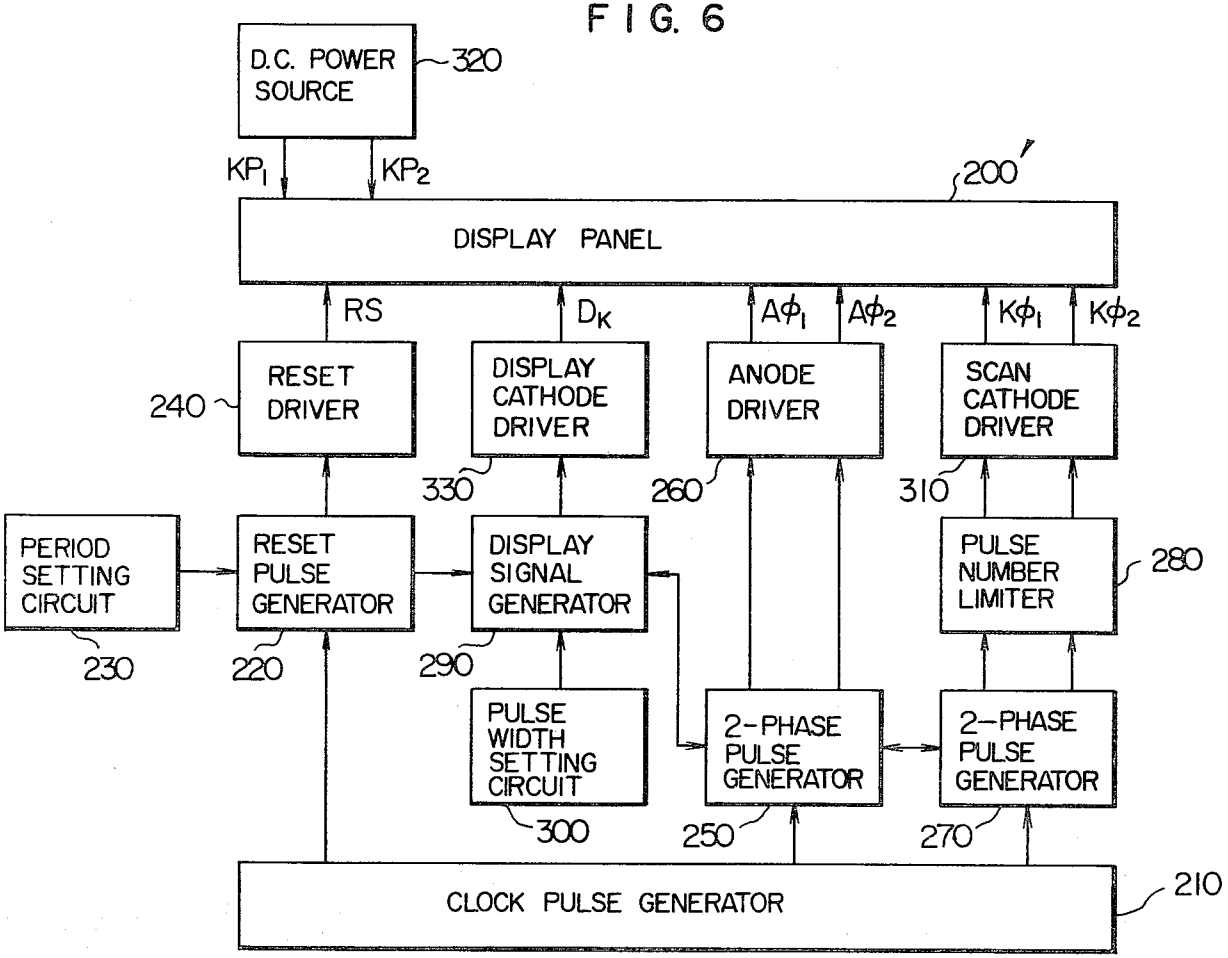
Figure 7:
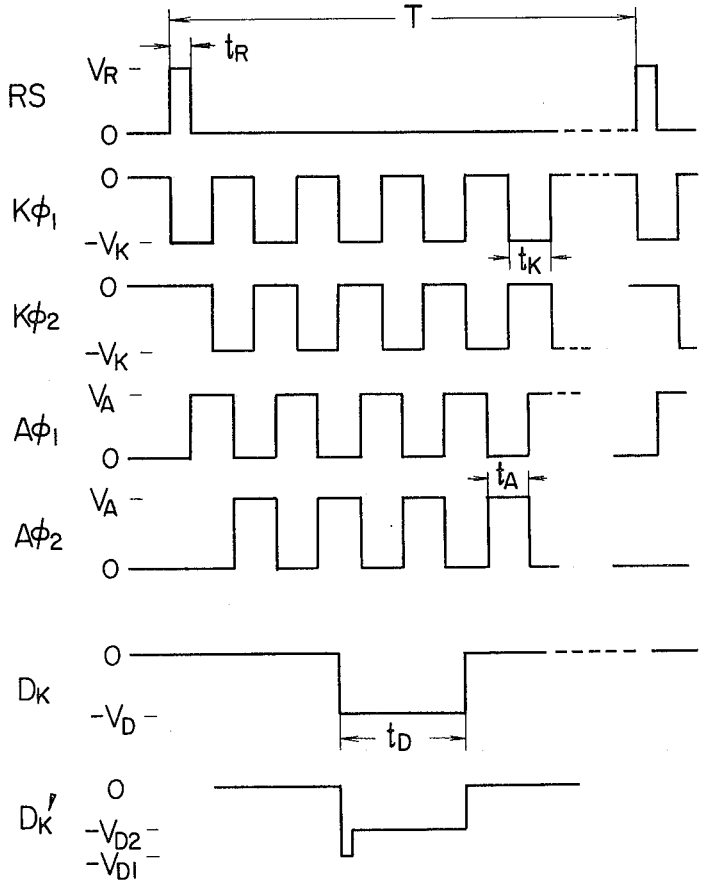
Figure 8A:
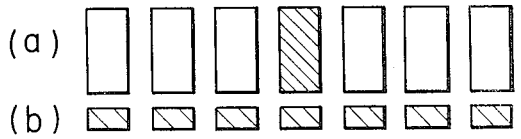
Figure 8B:
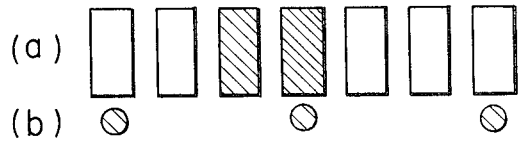
Figure 10:
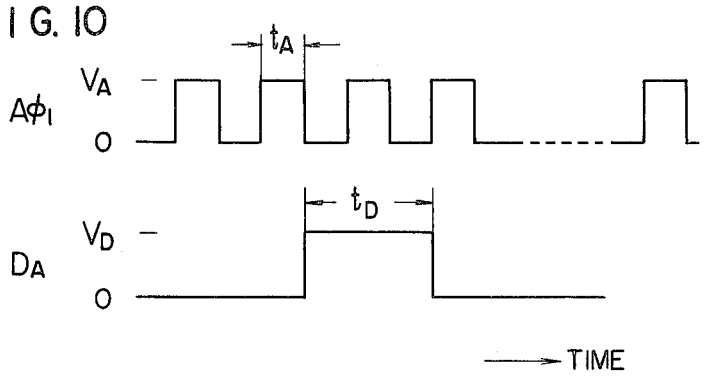
Figure 11:
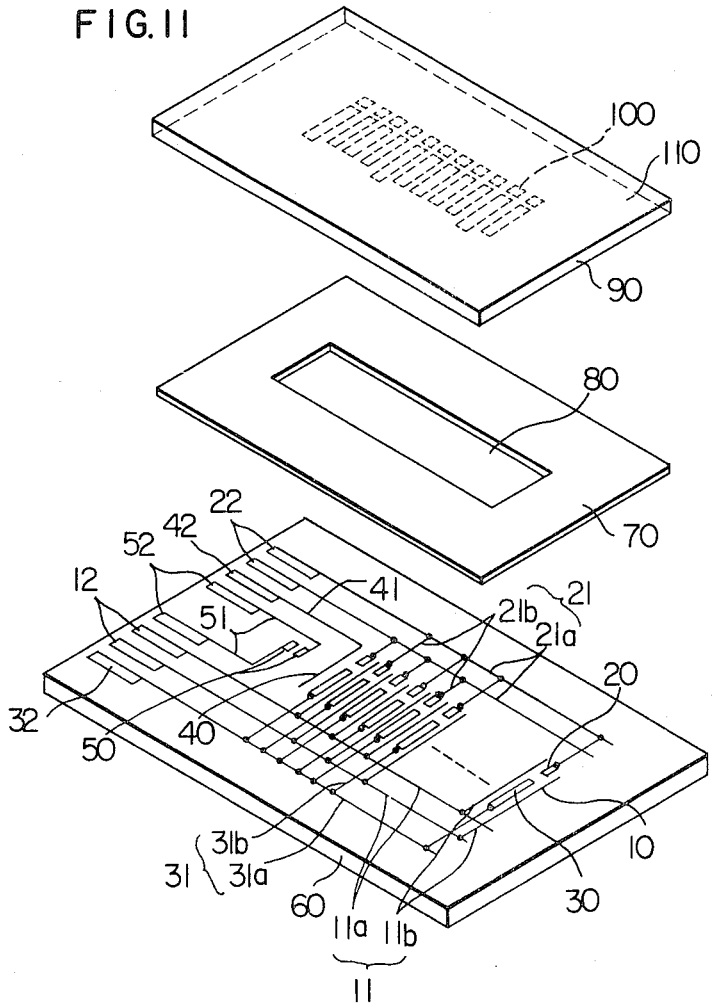

FIGS. 4A and 4B schematically show patterns of display as produced by the gas discharge display apparatus;

FIG. 5 is a view to illustrate an arrangement of electrodes and connections of a display panel incorporated in the gas discharge display apparatus according to another embodiment of the invention;

FIG. 6 is a block diagram illustrating a circuit arrangement of the gas discharge display apparatus incorporating the display panel shown in FIG. 5;

FIG. 7 shows waveforms of driving voltages employed in the gas discharge display apparatus shown in FIG. 6;

FIGS. 8A and 8B illustrate displayed patterns produced by the display apparatus shown in FIG. 6;

FIG. 9 shows an arrangement of electrodes and connections in a display panel according to a further embodiment of the invention;

FIG. 10 illustrates waveforms of some driving voltages utilized in the display panel shown in FIG. 9; and FIG. 11 is an exploded perspective view of a display panel corresponding to the one shown in FIG. 5.

Figure 1:
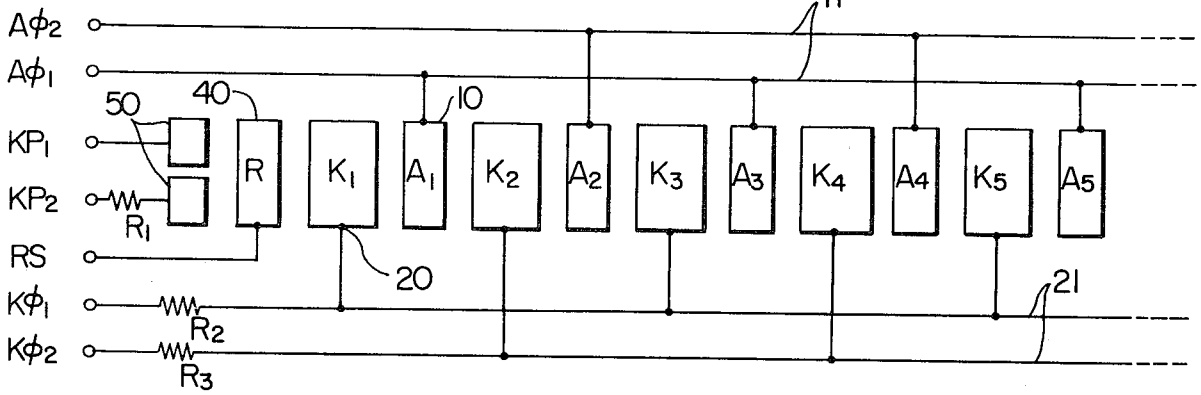
FIG. 1 is a view to illustrate an arrangement of electrodes and connections in a display panel incorporated in a gas discharge display apparatus according to an embodiment of the invention.

Now, the invention will be described in conjunction with a first exemplary embodiment thereof by referring to FIGS. 1 to 4. In FIG. 1, there is shown an arrangement of electrodes and connections for a bar-graph display which may be employed in carrying out the invention. Referring to this figure, a plurality of first electrodes 10 which serve as anode electrodes ($A_1$, $A_2$, . . . , $A_n$) and a plurality of second electrodes 20 which serve as the cathode electrodes ($K_1$, $K_2$, . . . , $K_n$) are alternately disposed oppositely to each other on a same plane or on different planes. The first electrodes (anodes) 10 and the second electrodes (cathodes) 20 are provided in polyphase connections, respectively. (In the case of the embodiment now being described, it is assumed that two-phase connection is adopted, for the convenience of description). The wires or conductors for the two-phase connections for the anodes and the cathodes are denoted by reference numerals 11 and 21, respectively. The wires 11 for the two-phase connection of the first electrodes (anodes) 10 are connected to terminals $A\phi_1$ and $A\phi_2$, respectively. On the other hand, the wiring conductors 21 for the two-phase connection of the second electrodes (cathodes) 20 are connected to terminals $K\phi_1$ and $K\phi_2$, respectively, through associated discharge stabilizing resistors $R_2$ and $R_3$.

Alternatively, these discharge stabilizing resistors $R_2$ and $R_3$ may be inserted in series connection between a driving circuit (not shown in FIG. 1 but will be described hereinafter) and the terminals $A\phi_1$ and $A\phi_2$, respectively. On the left side of the first cathode electrode $K_1$ as viewed in FIG. 1, there is disposed a reset electrode 40 labelled R which is directly connected to a terminal RS. Further, a pair of keep-alive electrodes 50 are disposed to the left side of the reset electrode (R) 40, as viewed in FIG. 1. One of the keep-alive electrodes 50 is connected to a terminal $KP_2$ through a discharge current limiting resistor $R_1$, while the other keep-alive electrode 50 is connected directly to a terminal $KP_1$.

Figure 2:
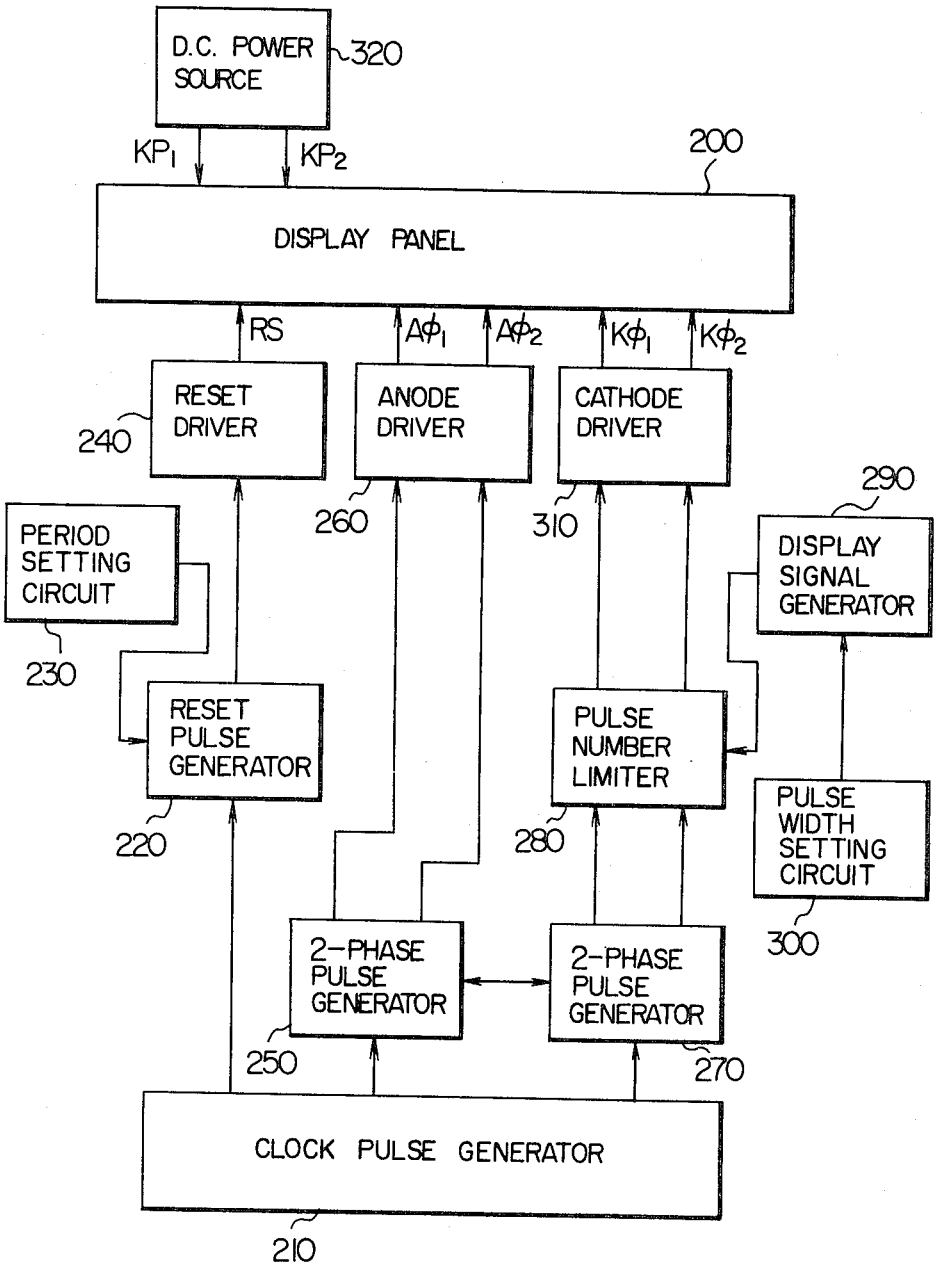
FIG. 2 is a block diagram to illustrate an arrangement of the gas discharge display apparatus.
Figure 3:
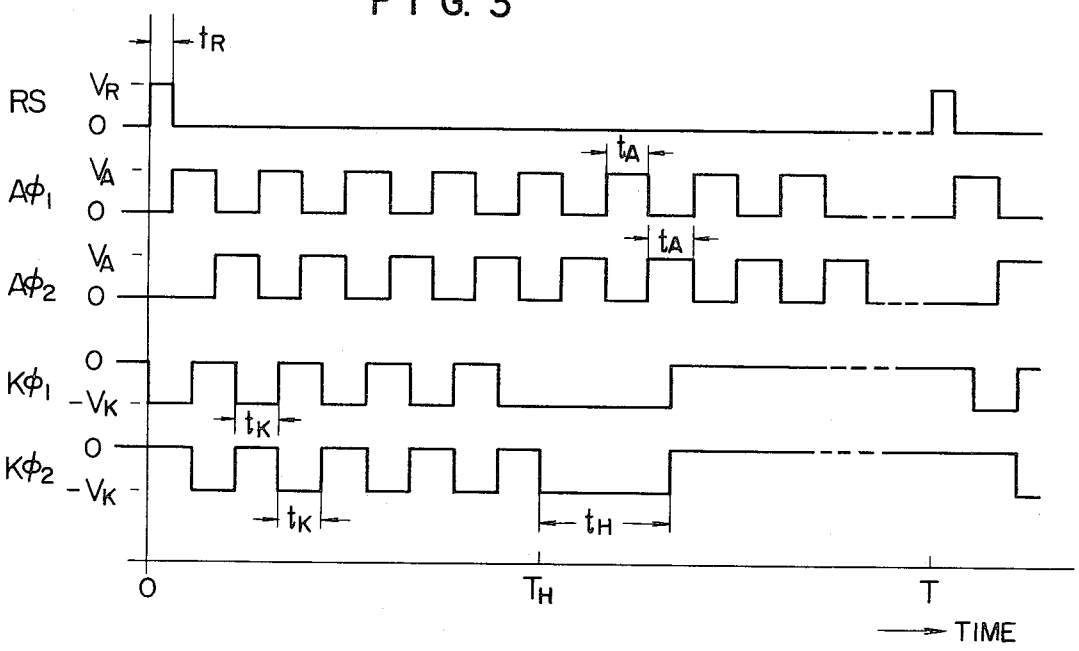
FIG. 3 illustrate waveforms of driving voltages employed in the gas discharge display device.

Next, operation of the display panel of the arrangement mentioned above will be described by referring to FIGS. 2 to 4, in which FIG. 2 shows in a block diagram a general arrangement of a gas discharge display device or apparatus according to an embodiment of the invention, and FIG. 3 shows a driving voltage waveform diagram to illustrate, by way of example, waveforms and timing relation of pulse voltages applied to the various terminals of the display panel shown in FIG. 1. In FIG. 3, the pulse voltages as applied to the respective terminals are identified by the same symbols as those attached to the terminals. Referring to FIG. 2, the display panel shown in FIG. 1 is generally denoted by a reference numeral 200. A numeral 210 denotes a clock pulse generator circuit for producing a basic clock signal. A reset pulse generator circuit 220 counts down the clock pulses produced by the clock pulse generator circuit 210 to thereby produce a reset pulse signal of a pulse width or duration $t_R$ with a period T, as is shown in FIG. 3 at RS. The period T can be adjusted by a period setting circuit 230. The reset pulse signal produced from the reset pulse generator circuit 220 is amplified by a reset driver circuit 240 to a required voltage level $V_R$ and thereafter supplied to the reset electrode 40 through the terminal RS. A two-phase anode driving pulse generator 250 serves to derive from the basic clock pulse signal a two-phase anode driving pulse signal of the pulse duration $t_A$ with a period $2t_A$ on a time series base. The anode driving pulse trains of two-phase thus produced are amplified to a required voltage level $V_A$ by an anode driver circuit 260 and thereafter applied to the associated anode electrodes 10 through the terminals $A\phi_1$ and $A\phi_2$, respectively. The waveforms as well as the timing of the two-phase anode driving pulse trains are exemplarily illustrated in FIG. 3 at $A\phi_1$ and $A\phi_2$. On the other hand, a two-phase cathode driving pulse generator 270 serves to derive from the basic clock pulse signal a two-phase cathode driving pulse signal of a pulse duration $t_K$ and a period $2t_K$ (where $t_K$ is generally equal to $t_A$). The pulses of the two-phase cathode driving pulse signal are restricted or limited in number to a predetermined value (corresponding to a period $T_H$ shown in FIG. 3, for example) by a pulse number limiting circuit 280 in accordance with a signal supplied from a display signal generator circuit 290 which serves for determining the length of a bar graph to be displayed. The pulse width or duration of the cathode driving pulse signal can be controlled by a pulse duration control circuit 300 as indicated by $t_H$. The cathode driving pulse trains of two phases thus produced are then amplified to a required voltage value $V_K$ by a cathode driver circuit 310 and subsequently applied to the associated cathode electrodes 20 through the discharge stabilizing resistors $R_2$ and $R_3$ and the terminals $K\phi_1$ and $K\phi_2$, respectively. Waveforms as well as timing of the two-phase cathode driving pulse signals are exemplarily illustrated in FIG. 3 at $K\phi_1$ and $K\phi_2$. A D.C. power supply source 320 supplies a D.C. voltage to the keep-alive electrode 50 through the associated terminals $KP_1$ and $KP_2$ to thereby bring about a stable glow discharge which is effective for facilitating occurrence of a reset discharge between the electrodes R and $K_1$, this reset discharge serving for determining the repetition time instant T of display.

Upon application of various pulse voltages in the manner described above in the timing relation illustrated in FIG. 3, the reset discharge taking place between the electrodes R and $K_1$ is successively transfered to the electrode pairs or display elements ($K_1$ and $A_1$), ($A_1$ and $K_2$), ($K_2$ and $A_2$), and so forth (implementation of the self-scanning performance). The transfer or self-scanning of the reset discharge is terminated at the electrode pair $K_i$ and $A_i$ (where i is a given positive integer of 1, 2, . . . , n) of the position which is determined in dependence on the quantity of information (measured quantity) represented by the input signal. This position corresponds to the termination of the period $T_H$ shown in FIG. 3 in the case of the illustrative embodiment. In this connection, it should be noted that the i−th and (i−1)−th display elements which are located at the head of the bar-graph display are activated for the duration $t_H$ (refer to FIG. 3), while the first to the (i−2)−th display elements (i.e. all the display elements except for those located at the head of bar-display) are activated for the duration $t_K$. Accordingly, the ratio of light emission between the heading display elements and the other display elements is given by $t_H/t_K$. To facilitate the understanding of such discharge mode, there is schematically shown in FIG. 4A an array of the display elements on the assumption that i is selected equal to 7. In this figure, the heading or leading display elements are located in a region denoted by b, while the other display elements are located in a region denoted by a, with both regions a and b being displayed as indicated by hatched blocks. When the brightness of the display elements located in the region a is represented by $B_K$ with the brightness of the heading display elements of the region b being represented by $B_H$, the ratio of brightness between the light emitting regions a and b is equal to the ratio of the light emitting durations $t_H$ and $t_K$, that is, $B_H/B_K=t_H/t_K$, because the brightness is substantially in proportion to the light emitting duration of the individual display elements. When selection is made such that $t_H>t_K$ in order to improve the visual recognizability or visibility of the region b by enhancing the contrast, the heading region b shown in FIG. 4A of the bar-graph display is emphasized in brightness. Of course, it is possible to select such that $t_H<t_K$. In this way, the brightness of the two display elements located at the head of the bar-graph display can be simultaneously and arbitrarily adjusted to a desired level by correspondingly varying the duration $t_H$ which can be substantially arbitrarily selected. This feature is very advantageous in improving the visibility of the heading region a of the displayed bar-graph. By way of example, a display panel for test was realized with the arrangement shown in FIG. 1 and filled with a gas mixture of He - Xe (0.3%) under 320 Torrs. The test panel was driven under the conditions that T=9 ms, $t_A=t_K=150$ μs, and that $V_K=V_A=130$ V. The brightnesses $B_K$ and $B_H$ were measured by varying the duration $t_H$. When $t_H$ and $t_K$ were selected equal to 0.15 ms, the brightness $B_H$ and $B_K$ were both measured equal to 100 fL. When $t_H$ was selected equal to 0.5 ms, the brightness $B_H$ of the heading region b (see FIG. 4A) was increased to 270 fL. When $t_H$ was 1.0 ms, the brightness was measured equal to 460 fL. In this way, it is possible to increase significantly the brightness of the heading region b of the displayed bar (FIG. 4A) by varying the duration $t_H$. By taking advantage of this feature, it is possible to control the duration $t_H$ and hence the brightness of the heading region b of the displayed bar as a function of the room brightness or ambient illumination. For example, the duration $t_H$ may be selected longer in the daytime and shorter in the nighttime to thereby maintain the visibility to be constant. By the way, magnitudes or lengths of the durations $t_K$ and $t_A$ may be selected in a range in which the self-scanning performance described hereinbefore can be effected normally. In the case of the test panel described above, $t_K$ and $t_A$ are selected from the range of 50 μs to 300 μs.

In the foregoing description, it has been assumed that the two-phase driving connections are made to the anodes and the cathodes, respectively, of the display panel. It will however be readily understood that the invention is not restricted to the two-phase system, but can be realized with an increased number of phases. Thus, assuming that n-phase driving connections are adopted where n is a given integer of 2, 3, 4 and so forth, it is possible to make the brightness of n display elements to be variable. Further, it is also possible to increase the brightness of the other elements (n−1) times as high.

In a modification of the circuit arrangement shown in FIG. 1, the heading region of the bar-like graph which is emphasized in brightness in the display of the two-phase system described above may be constituted by a single display element, as shown in FIG. 4B, by connecting the discharge stabilizing electrodes $R_2$ and $R_3$ in series to the poly (two)-phase anode driving conductors 11, respectively, instead of connecting these resistors in series to the two-phase cathode driving conductors 12. The reason can be explained as follows. Namely, assuming that the discharge takes place between a certain anode electrode and a cathode electrode which is located adjacent to the anode at the lefthand side thereof, then discharge is prevented from occurring between the said anode electrode and a cathode electrode which is positioned adjacent thereto at the righthand side, even when the driving voltage of a same amplitude as that of the voltage applied to the lefthand cathode electrode is applied to the righthand cathode. This is because a discharge drop occurs due to the presence of the discharge stabilizing resistor connected to the anode.

The foregoing description has been made in conjunction with the display of a single bar-graph, for convenience' sake. It should however be understood that a plurality of different bar-graphs can be simultaneously produced by controlling or driving the cathode electrodes separately and independently with the anode electrodes being used in common.

Briefly, there has been provided in accordance with an aspect of the present invention a gas-discharge display apparatus which includes a number of first electrodes (anodes) connected in n-phase connection and a number of second electrodes (cathodes) connected in m-phase connection where n and m represent positive integers of 2, 3 and so forth and may be selected such that $n \neq m$, wherein discharge produced between the adjacent anode and cathode electrodes (i.e. electrode pair) is progressively and sequentially transferred to the succeeding electrode pairs (i.e. performs self-scanning) by applying driving pulse voltages. By varying the pulse width of the pulse voltages applied to the second electrodes through discharge stabilizing resistors from the duration $t_K$ to $t_H$ at the specific time instant $T_H$ determined in accordance with the input signal or information to be displayed, the brightness of the heading or leading portion b (consisting of m display elements) of the displayed bar-graph having a length corresponding to the quantity of information to be displayed can be increased by a factor corresponding to the ratio $t_H/t_K$ as compared with the remaining portion of the displayed bar-graph, whereby the visibility of the produced bar-graph display can be significantly improved. Further, when the pulse width or duration $t_H$ is varied correspondingly in dependence on the room or ambient illumination, the visibility (i.e. visual recognizability) can be maintained to be substantially constant independently from the ambient illumination. By merely inserting, the discharge stabilizing resistors in the n-phase connecting conductors leading to not the cathode electrodes but the anode electrodes, it is possible to increase only the brightness of the single heading display element by a factor corresponding to the ratio $t_H/t_K$ as compared with the other display elements. Thus, the number of the display elements located in the heading region b of the displayed bar-graph whose brightness is to be emphasized can be controllably varied by closing or opening in appropriate manners the discharge stabilizing resistor circuits connected to the anode electrodes in combination with the discharge stabilizing resistor circuits connected to the cathode electrode. Further, by selecting appropriately the values of the pulse drive voltages $V_A$ and $V_K$ applied for every time instant $T_H$ as well as resistance values of the discharge stabilizing resistors $R_2$ and $R_3$, the relation in brightness between the groups of the display elements to be emphasized and deemphasized, respectively, can be reversed.

Next, a second exemplary embodiment of the invention will be described in conjunction with FIGS. 5 to 8. Referring to FIG. 5 which shows an array of electrodes and wirings in a display panel which can be incorporated in the gas discharge display apparatus according to the invention, it will be seen that each of the cathode electrodes corresponding to those designated by the numeral 20 in FIG. 1 is divided into a scan cathode 20 (labelled with $K_1, \ldots, K_n$) and a third electrode 30 serving as a cathode $D_1, \ldots, D_n$) for display (also referred to as the display cathode), wherein the self-scanning performance is realized through transfer of auxiliary or scan discharge produced between the first or anode electrode and the scan cathode electrode, while main discharge for the display of information is produced between the first or anode electrode and the third electrode 30 (i.e. cathode electrode for display). By applying the pulse voltage to the third or display-cathode electrodes 30 at a time interval corresponding to the quantity of information or input signal to be displayed, the information or input signal is displayed in the form of a cursor.

In more particular, referring to FIG. 5, there is disposed in opposition to each of the first or anode electrodes 10 (labelled $A_1, A_2, \ldots, A_n$) a pair of the second electrode 20 for effecting the self-scanning (referred to as the scan cathode and labelled $K_1, K_2, \ldots, K_n$) and the third electrode 30 serving for display of information (referred to as the display cathode and labelled $D_1$, $D_2$, . . . , $D_n$) to thereby constitute a set of electrodes or an electrode set which corresponds to the electrode pair described hereinbefore in conjunction with the display panel shown in FIG. 1 and constitutes the single display element. A number of such electrode sets in which the first, second and the third electrodes are disposed on a same plane or in which at least the second electrode 20 and the third electrode 30 are disposed on different planes, respectively, are arrayed linearly in a single row. At one end (lefthand end as viewed in FIG. 1) of the linear electrode array, there are provided the reset electrode 40 (labelled R) and a pair of the keep-alive electrodes 50 in a manner similar to the arrangement shown in FIG. 1. The first or anode electrodes 10 and the second or scan-cathode electrodes 20 are connected in a polyphase connection, respectively. In the case of the illustrated embodiment, two-phase connections are assumed to be adopted for facilitating the description. These two-phase connection wires or conductors are denoted by the reference numerals 11 and 21, respectively. On the other hand, the plurality of the third or display electrodes 30 may be connected in a single-phase connection for the display with a single dot or alternatively in a p-phase connection for the display with p dots (where p represents a selected positive integer of 2, 3, 4 and so forth). In the case of the embodiment now being described, however, the third electrodes 30 are shown as connected in the single-phase connection for the convenience of description. The single-phase connection wire is designated by a reference numeral 31. The connecting wire 31 for the third electrodes (display cathodes) 30 is connected to a terminal $D_K$ through a discharge stabilizing resistor $R_4$, while the two-phase connecting wires 21 for the second electrodes (scan cathodes) 20 are connected to the terminals $K\phi_1$ and $K\phi_2$ through the discharge stabilizing resistors $R_2$ and $R_3$, respectively. In this connection, it should be mentioned that the discharge stabilizing resistors $R_2$, $R_3$ and $R_4$ may be inserted between driver circuits (not shown in FIG. 5) and the terminals $K\phi_1$, $K\phi_2$ and $D_K$, respectively. The reset electrode 40 is connected directly to the terminal RS. One of the keep-alive electrodes 50 is connected to the terminal $KP_2$ through a discharge current limiting resistor $R_1$, while the other is connected directly to the terminal $KP_1$.

Next, operations of the display panel device shown in FIG. 5 will be described by referring to FIGS. 6 to 8A and 8B, in which FIG. 6 shows in a block diagram a circuit arrangement of the gas discharge display apparatus which incorporates the display panel device shown in FIG. 5 according to another exemplary embodiment of the invention, and FIG. 7 schematically illustrates waveforms as well as timing of pulse voltages applied to the various terminals shown in FIG. 5, wherein the pulse voltages are labelled with the same reference symbols attached to the associated terminals. Now, referring to FIG. 6, a block 200' represents the display panel device shown in FIG. 5. A numeral 210 denotes a clock pulse generator for producing a basic clock pulse signal. A reset pulse generator circuit 220 counts down the clock pulses produced by the clock pulse generator circuit 210 to thereby produce a reset pulse signal having a pulse width or duration $t_R$ and a period T, as is shown in FIG. 7 at RS. The period T can be adjusted by a period setting circuit 230. The reset pulse signal thus produced is amplified by a reset driver circuit 240 to a required voltage level $V_R$ and thereafter supplied to the reset electrode 40 through the terminal RS. A two-phase anode driving pulse generator 250 serves to derive from the basic clock pulse signal a two-phase anode driving pulse signal having a pulse duration $t_A$ and a period $2t_A$ on a time series base. The anode driving pulse trains of two phases thus produced are amplified to a required voltage level $V_A$ by an anode driver circuit 260 and thereafter applied to the associated individual anodes 10 through the terminal $A\phi_1$ and $A\phi_2$, respectively. The waveforms as well as the timing of the two-phase anode driving pulse trains are exemplarily illustrated in FIG. 7 at $A\phi_1$ and $A\phi_2$, respectively. On the other hand, a two-phase scan-cathode driving pulse generator 270 serves to derive from the basic clock pulse signal a scan-cathode driving pulse signal of a pulse duration $t_K$ and a period $2t_K$ (where $t_K$ is generally equal to $t_A$) on a time-series base, which is then amplified by a scan-cathode driver circuit 310 to a predetermined voltage value $V_K$. The two-phase scan-cathode driving pulse trains thus conditioned are then supplied to the associated scan-cathodes 20 (i.e. second electrodes) through the terminals $K\phi_1$ and $K\phi_2$, respectively. The waveforms and timing of these pulse trains are exemplarily illustrated in FIG. 7 at $K\phi_1$ and $K\phi_2$, respectively. The pulses of the two-phase pulse trains available from the two-phase scan-cathode driving pulse generator 270 or the two-phase anode driving pulse generator 250 are restricted to a predetermined number corresponding to the length of the scan-discharge (or scan-display) by means of the pulse number limiting circuit 280. In the case of the embodiment now being described, the pulse number of the two-phase scan-cathode driving pulse trains is destined to undergo such restriction or limitation. In this conjunction, synchronization may be established with the display signal generator circuit 290.

Upon application of the various pulse voltages between the first electrodes 10 and the second electrodes 20 successively on the time series base in the timing relation illustrated in FIG. 7, a reset discharge first taking place between the electrodes R and $K_1$ is successively transferred or shifted to the electrode pairs ($K_1$ and $A_1$), ($A_1$ and $K_2$), ($K_2$ and $A_2$), and so forth, whereby the self-scanning performance is realized. In this manner, the number of the various terminals and driver circuits can be reduced to a minimum notwithstanding a large number of the electrodes to be driven. The pair of the keep-alive electrodes 50 are constantly supplied with a steady D.C. current from a D.C. power supply source 320, resulting in occurrence of a glow discharge, which is effective to facilitate occurrence of the reset discharge between the electrodes R and $K_1$.

Next, operation for displaying information in a cursor-like fashion will be described. The discharge for display (also referred to as the display discharge in contrast to the scan discharge) is caused to be selectively produced between the first (anode) electrodes 10 and the third (display-cathode) electrodes 30 by making use of ionization coupling with the scan discharge produced between the first (anode) electrodes 10 and the second (scan-cathode) electrodes 20 described above. By virtue of this feature, the display discharge can be produced even at a relatively low level of the driving voltage with a high response speed and can be sustained for a desired duration. Waveform and timing of the display-cathode driving pulse signal applied to the third electrodes 30 are exemplarily illustrated in FIG. 7 at $D_K$. The display-cathode driving pulse signal is produced by the display signal generator 290 and has a pulse width $t_D$ which is set by a pulse duration setting circuit 300 and utilized for adjusting the brightness of display.

The pulse voltage signal produced by the display signal generator circuit 290 is amplified to a predetermined voltage level $V_D$ by the display-cathode driver circuit 330 and then applied to the display cathodes 30 by way of the terminal $D_K$.

A display pattern produced in the manner described above is schematically illustrated in FIG. 8A. A hatched block represents the display element of a display field (a) which is selected for display in accordance with the input display signal. At that time, display may be simultaneously produced also in a scan field (b) in such manners as illustrated in FIGS. 8A and 8B. The display in the scan field (b) can be made use of as a representation of the whole length of a bar graph (i.e. the range of display for the input signal), or as a scaler or the like, to a great advantage. The electrode arrangement shown in FIG. 5 is very advantageous in that only a selected display element can be energized with a given brightness independently from the scan field (b) constituted by the scan electrodes 20.

When a high voltage pulse $D_K'$ (FIG. 7) of a short duration (on the order of 5 μs) is superposed on the display-cathode driving pulse voltage $D_K$ upon application thereof, operation margin for display can be significantly increased.

Next, the reason why the display discharge can be sustained or maintained for a desired duration, which is an important feature of the display panel device shown in FIG. 5, will be elucidated below. It is assumed that the pulse voltage signal $D_K$ having a duration $t_D$ and an amplitude $V_D$ (refer to FIG. 7, $D_K$) is applied to the third electrode with a predetermined timing in correspondence to the display element to be selected for display. In this connection, the voltage amplitude $V_D$ has to be selected such that a sum of the voltages $V_D$ and $V_A$ (a sum of voltages $V_{D1}$ and $V_A$ when the voltage $V_{D1}$ concerns) is higher than the breakdown voltage of the display discharge in the presence of the ionization coupling with the scan discharge and lower than the breakdown voltage in the absence of the ionization coupling. Under these conditions, display discharge can take place at the selected display element, resulting in that a discharge current $I_D$ will flow between the third electrode of the selected display element and the first electrodes disposed adjacent to the third electrode on the lefthand and right hand sides thereof, alternately. When the discharge current $I_D$ begins to flow, a voltage drop $I_DR_4$ is produced in the discharge stabilizing resistor $R_4$ shown in FIG. 5, as the result of which the operative third electrode is applied with a voltage represented by $-(V_D-I_DR_4)$ or $-(V_{D2}-I_DR_4)$ when the pulse voltage $D_K'$ concerns. The value of voltage $(V_D-I_DR_4)$ or $(I_{D1}-I_DR_4)$ must be such that the value of $(V_A+V_D-I_DR_4)$ is higher than a minimum maintenance voltage for the display discharge in the presence of the ionization coupling with the scan discharge and lies in a bi-stable region which is lower than the breakdown voltage in the presence of the ionization coupling. With the terminology "bi-stable region", it is intended to mean a voltage region lying between the breakdown voltage and the minimum maintenance (discharge sustaining) voltage. In the so-called bi-stable region, discharge once triggered is sustained so far as the voltage in the bi-stable region is applied, while discharge can never take place merely by applying the voltage of the bi-stable region without triggering the discharge. This phenomenon is referred to as the bi-stable characteristic of discharge or memory effect. In this way, discharge once triggered by the voltage having a value determined in the manner described above and applied to the third electrode is maintained or sustained so long as the voltage of the bistable region is being applied (implementation of memory function). Thus, the period during which the display discharge may take place is determined by the pulse width $t_D$ of the applied pulse voltage $D_K$ or $D_K'$. Since the brightness of display is in proportion to the period during which the display discharge is produced (i.e. the display period), the display brightness can be continuously controlled and selected to desired values by correspondingly controlling the pulse width or duration $t_D$. By way of example, a test discharge device implemented in the configuration shown in FIG. 5 was operated on the driving conditions that T=9 ms, $t_K=t_A=150$ μs, $V_K=130$ V, $V_A=140$ V (volts), and $V_D=140$ V. When $t_D$ was selected equal to 75 μs, brightness B of a green dot ($Zn_2SiO_4$:Mn) was measured 40 fL. For $t_D=150$ μs, the brightness B was 75 fL. For $t_D=300$ μs, B was 135 fL. When $t_D=600$ μs, B was 235 fL. When $t_D=1.2$ ms, the brightness was 400 fL. Thus, it is possible to increase continuously the display brightness B.

By the way, the display element (or position) to be energized can be controlled by the timing at which the display-cathode driving pulse is applied. Further, when the scan-cathode driving pulse is controlled in accordance with the input information signal, the scan field (b) (refer to FIGS. 8A and 8B) can produce a bar-graph display of a length corresponding to a quantity represented by the input information signal (FIG. 8A). The display can thus be produced in various patterns.

It will now be appreciated that a great number of display elements can be driven with only six driver circuits and input terminals to energize a desired display element with a freely variable and high brightness by virtue of the self-scan function and the memory function implemented in the gas discharge display apparatus described above in conjunction with FIGS. 5 to 8A and 8B.

The above description has been made in conjunction with the display panel of a single-dot display type. Display with two dots can be easily accomplished by connecting the discharge stabilizing resistor to each of the two-phase conductors connected to the third electrodes 30 and selecting the time delay involved between the successive pulse applied to the phase conductors equal to $t_K$. In general, display with n dots is realized in the similar manner.

It is also possible to make the first electrodes serve as the cathodes ($K_1, K_2, \ldots, K_n$), the second electrodes 20 as the scan anodes ($A_1, A_2, \ldots, A_n$) and the third electrodes 30 as the display anodes ($D_1, D_2, \ldots, D_n$). An array of the electrodes as well as the connections which may be adopted in the display panel to this end are exemplarily illustrated in FIG. 9. The discharge stabilizing resistors are similarly connected to the conductors 21 (two-phase conductors in the illustrative case) and 31 (one-phase conductors in the illustrative case), respectively.

Since operation of the display panel of the arrangement shown in FIG. 9 is essentially similar to that of the display panel shown in FIG. 5, any further description will be unnecessary. However, it should be mentioned that the pulse voltage applied to the third electrodes 30 is of the polarity inverted relative to the pulse voltage $D_K$ shown in FIG. 7, because the third electrode 30 is destined to serve as the anode electrode for display. Waveform and timing of the display-anode driving pulse voltage applied to the display anodes 30 ($D_1$, $D_2$, . . . , $D_n$) are exemplarily illustrated in FIG. 10 together with the scan-anode driving pulse voltage signal applied to the scan anodes 20 ($A_1$, $A_2$, . . . , $A_n$). In FIG. 10, the pulse voltage signal applied to the terminal $A\phi_1$ shown in FIG. 9 is illustrated at $A\phi_1$, while the pulse voltage signal applied to the terminal $D_A$ is illustrated at $D_A$. The pulse voltage signal $A\phi$ shown in FIG. 10 is same as the signal $A\phi_1$ shown in FIG. 7. The waveforms and the timings of the pulse voltage signals applied to the other terminals RS, $A\phi_2$, $K\phi_1$ and $K\phi_2$ may be same as those shown in FIG. 7 at RS, $A\phi_2$, $K\phi_1$ and $K\phi_2$, respectively. In this connection, the amplitude $V_D$ of the display-anode driving pulse signal should be necessarily and adequately selected such that the voltage sum $(V_D+V_K)$ is higher than the breakdown voltage for the display discharge in the state of ionization coupling with the scan discharge and that the voltage sum $(V_D+V_K-I_DR_4)$ is higher than the minimum maintenance voltage for sustaining the display discharge and lies within the bi-stable region defined hereinbefore.

An important advantage of the gas discharge display apparatus incorporating the display panel device shown in FIG. 9 can be seen in the fact that the display discharge in a form of two successive dots such as shown in FIG. 8B can be produced with the single-phase connection to the third electrodes 30 without increasing the number of phase conductors, provided that $t_D \geqq 2t_K$, because the display anode as selected can cooperate alternately with the adjacent cathodes disposed at both sides thereof. It is to be noted that when $t_D=\frac{1}{2}\cdot t_K$, the display is made with the single dot. When selection is made such that $t_D \geqq 2t_K$, the cathodes located at both sides of the selected display anode will be driven for a period of $\frac{1}{2}\cdot t_D$, respectively. As the consequence, brightness of the selected display element indicated by the hatched block in FIG. 8B is substantially equal to a half of the brightness of the selected display element represented by the hatched block in FIG. 8A.

FIG. 11 shows schematically in an exploded perspective view a physical structure of the display panel shown in FIG. 5. For fabrication, an insulation substrate 60 formed of soda glass is prepared, on which the terminals 12, 22, 32, 42 and 52, connections 41 and 51 leading to the reset electrode 40 and the keep-alive electrode 50, respectively, a bus 31*a* leading to the third electrodes 30, lead wires 31*b* leading to the bus 31*a* (the bus 31*a* and the lead wire 31*b* constituting the connections 31 between the display electrodes 30 and the terminal 32), and lead wires 11*b* and 21*b* extending between the first electrodes 10 and the second electrodes 20, respectively, are formed of gold paste or the like through a known printing and firing process.

Next, the first electrodes 10, the second electrodes 20, the third electrodes 30, the reset electrode 40 and the keep-alive electrodes 50 are simultaneously formed of Ni-paste through the printing and firing process. Thus, the third electrodes 30, the reset electrode 40 and the keep-alive electrodes 50 are connected to the terminals 32, 42 and 52 through the conductors 31, 41 and 51, respectively. An insulation layer such as cover glass (not shown) is formed so as to cover the printed substrate except for those portions which correspond to the various electrodes, terminals and connections (through-hole connections) between the lead conductors 11*b* and 21*b* and bus bars described below.

Next, the bus bars 11*a* and 21*a* leading to the first electrodes 10 and the second electrodes 20 are formed of a gold paste or the like on the insulation layer. Thus, the first and second electrodes 10 and 20 are connected to the terminals 12 and 22 through the connections 11 and 21, whereupon all the required connection between all the electrodes and terminals have been accomplished.

Subsequently, a thin insulation layer (not shown) is deposited all over except for the locations overlying electrodes and the terminals.

A spacer 70 formed of soda glass or the like and having a discharge cavity 80 is disposed on the assembly. Finally, a transparent face plate 90 formed of soda glass or the like is disposed on the spacer 70. The rear surface of the face plate 90 is provided with a light-shielding black matrix formed of black glass paste through printing and firing except for display portion 100, to thereby improve the contrast of display. For the display in color, the display portion is applied with phosphor.

The substrate 60, the spacer 70 and the face plate 90 thus prepared are then stacked one another and sealed with glass frit around the periphery. After evacuation to a high vacuum degree, a gas mixture such as Ne - Ar, He - Xe or the like is hermetically filled in under pressure of 100 to 500 Torrs. A finished display panel is obtained. The gas mixture may be admixed with a small quantity of Hg for preventing spattering.

In the foregoing, description has been restricted to a single bar-graph display for convenience' sake only. It will be readily appreciated that bar-graph displays can be produced in a plurality of rows or columns by arraying the third electrodes in plural rows or columns with the first electrodes being used in common.

In summary, there has been provided according to another aspect of the invention a display panel for a gas discharge display apparatus which includes first common electrodes, and second and third electrodes which are disposed in pair in opposition to the associated first common electrode at both sides thereof, wherein scan discharge is caused to be produced between the first and the second electrodes for accomplishing the self-scan function, to thereby allow the number of the driver circuits and the terminals to be reduced significantly. The discharge for display is produced between the first and the third electrodes by making use of the ionization coupling with the scan discharge mentioned above. A memory function is realized by utilizing the bi-stable characteristic of the display discharge with a view to enhancing the brightness of display. Adjustment of brightness can be continuously performed in a simplified manner by controlling the timing at which the display discharge is caused to occur. Power consumption of the display apparatus can be remarkably reduced by the display in a cursor-like fashion, while the reliability as well as the use life of the apparatus can be surprisingly improved.

What is claimed is:

1. A gas discharge display apparatus, capable of emphasis display, comprising a plurality of first electrodes disposed in a row and wired in polyphase connection, and plurality of second electrodes wired in polyphase connection and interposed between and spaced from said first electrodes so that said first and second electrodes are disposed in the row when viewed in a predetermined direction, first voltage applying means for applying successively first pulse voltages having a value which is one of a greater and lesser value than a predetermined reference value to common leads to said first electrodes, and second voltage applying means for applying successively second pulse voltages having a value which is the other of the greater and lesser value than the predetermined reference value to common leads to said second electrodes so that a self-scanning discharge is produced between said first and second electrodes by said first and second pulse voltages, wherein the apparatus further comprises discharge stabilizing resistors connected to the common leads to either one of said pluralities of first and second electrodes, and means for controlling the pulse width of said second pulse voltage pulses to intensify illumination due to the discharge between specified first and second electrodes at an end portion of the self-scanning in response to an input signal to be displayed, whereby said discharge is sustained between said selected ones of said first and second electrodes by said discharge stabilizing resistors which causes the voltage between said first and second electrodes to lie between a discharge starting voltage and a minimum discharge maintenance voltage.

2. A gas discharge display apparatus, capable of emphasis display, comprising a plurality of first electrodes disposed in a row and wired in polyphase connection, a plurality of second and third electrodes interposed between and spaced from said first electrodes so that both said first and second electrodes, and said first and third electrodes are alternately disposed in the row when viewed in a predetermined direction, said second electrodes being wired in polyphase connection, said third electrodes being wired in one of a polyphase and single phase connection, first voltage applying means for applying successively first pulse voltages having a value which is one of a greater and lesser value than a predetermined reference value to the connections leading to said first electrodes, and second voltage applying means for applying successively second pulse voltages having a value which is the other of the greater and lesser value than the predetermined reference value to the connections leading to said second electrodes so that a self-scanning discharge is produced between said first and second electrodes by said first and second pulse voltages, wherein the apparatus further comprises discharge stabilizing resistors connected to the connections leading to either one of said pluralities of first and second electrodes and said plurality of third electrodes, respectively, and third pulse voltage applying means for applying third pulse voltages, having a value which corresponds to the value of said second pulse voltage, to each of the connections leading to said third electrodes at a predetermined time instant determined in accordance with an input signal to be displayed, whereby discharge is caused to occur, between selected ones of said first electrodes and said third electrodes upon application of said third pulse voltages, said selected electrodes being determined by said input signal, and said discharge being sustained between said selected ones of said first and third electrodes by said discharge stabilizing resistors which causes the voltage between said first and third electrodes to lie between a discharge starting voltage and a minimum discharge maintenance voltage.

3. A gas discharge display apparatus according to claim 1, further comprising pulse number limiting means for limiting the number of said second pulse voltages in accordance with said input signal whereby position of said self-scanning discharge is controlled by said pulse number limiting means.

4. A gas discharge display apparatus according to claim 1, wherein said pulse width control means is controlled in dependence on ambient illumination.

5. A gas discharge display apparatus according to claim 2, further comprising pulse number limiting means for limiting the number of either said first or said second pulse voltages whereby position of said self-scan discharge is controlled by said pulse number limiting means.

6. A gas discharge display apparatus according to claim 2, wherein a range in which said input signal is to the displayed is displayed by said self-scan discharge.

7. A gas discharge display apparatus according to claim 2, further comprising pulse duration controlling means for controlling pulse duration of said third pulse voltage whereby light emitting duration of the discharge produced between said selected ones of said first electrodes and said third electrodes is controlled by said pulse duration controlling means.

8. A gas discharge display apparatus according to claim 7, wherein said pulse duration controlling means is controlled in dependence on ambient illumination.

9. A gas discharge display apparatus capable of emphasis display comprising:

a plurality of first electrodes and a plurality of second electrodes alternately disposed wtih a predetermined spacing from each other in a row when viewed in a predetermined direction; said pluralities of first and second electrodes being arranged in a housing in which a gas is sealed;

first wire means for connecting in common said plurality of the first electrodes in a polyphase connection;

second wire means for connecting in common said plurality of the second electrodes in a polyphase connection;

discharge stabilizing resistors connected to either one of said first and second wire means;

driver means for producing self-scanning discharge between the first and second electrodes by successively applying to said first and second wire means first and second pulse voltages, respectively, said first pulse voltage having a value which is one of a greater and lesser value than a predetermined reference value, and said second pulse voltage having a value which is the other of the greater and lesser value than the predetermined reference value; and means for controlling a pulse width of said second pulse voltages to intensify illumination due to the discharge between specified first and second electrodes at an end portion of the self scanning in response to an input signal to be displayed.

10. A gas discharge display apparatus according to claim 9, wherein said housing includes:

first and second insulator substrates, at least one of said first and second insulator substrates being transparent; and insulating means inserted between said first and second insulator substrates, and having a space in which the gas is sealed;

said plurality of the first and second electrodes being formed on a surface of said first substrate facing the space of said insulating means.

11. A gas discharge display apparatus according to claim 10, further comprising fluorescent material coated at a portion on a surface of said second insulator substrate opposite to either of said first and second electrodes acting as cathode electrodes.

12. A gas discharge display apparatus according to claim 11, further comprising a layer in black color formed on the surface of said second insulator substrate at a portion other than the portion coated with said fluorescent material.

13. A gas discharge display apparatus capable of emphasis display comprising:

a plurality of first electrodes, second electrodes and third electrodes disposed in a housing in which a gas is sealed, said first electrodes being disposed in a row with a predetermined spacing therebetween, said second and third electrodes being disposed between and in opposition to said first electrodes with a predetermined spacing from said first electrodes so as to be disposed in the row when viewed in a predetermined direction;

first wire means for connecting said plurality of the first electrodes in a polyphase connection;

second wire means for connecting said plurality of the second electrodes in a polyphase connection;

third wire means for connectint said third electrodes in one of a single phase and polyphase connection;

discharge stabilizing resistors respectively connected to either one of said first and second wire means and to said third wire means;

first driver means for producing self-scanning discharge between the first and second electrodes by successively applying to said first and second wire means first and second pulse voltages, respectively, said first pulse voltage having a value which is one of a greater and lesser value than a predetermined reference value, and said second pulse voltage having a value which is the other of the greater and lesser value than the predetermined reference value; and second driver means for producing discharge, synchronized with said self-scanning discharge, between specified first and third electrodes by applying a third pulse voltage, having a value which corresponds to the value of the second pulse voltage, to said third wire means through said discharge stabilizing resistor at a predetermined time instant determined in accordance with the input signal to be displayed.

14. A gas discharge display apparatus according to claim 13, wherein said second driver means includes means for controlling a pulse width of said third pulse voltage so as to control a time duration of illumination due to the discharge between the specified first and third electrodes.

15. A gas discharge display apparatus according to claim 14, wherein said housing includes:

first and second insulator substrates, at least one of said first and second substrates being transparent; and insulating means inserted between said first and second electrodes, and having a space in which the gas is sealed;

said plurality of the first, second and third electrodes being formed on a surface of said first substrate facing the space of said insulating means.

16. A gas discharge display apparatus according to claim 15, further comprising fluorescent material coated at a portion on a surface of said second insulator substrate opposite to the electrodes among said first, second and third electrodes acting as cathode electrodes.

17. A gas discharge display apparatus according to claim 16, further comprising a layer in black color formed on the surface of said second insulator substrate at a portion other than the portion coated with said fluorescent material.

* * * * *